US007950380B2

(12) United States Patent
Yeh

(10) Patent No.: US 7,950,380 B2
(45) Date of Patent: May 31, 2011

(54) ADJUSTABLE PAINT BALL GUN TRIGGERS

(75) Inventor: Hsin Cheng Yeh, Yung Kang (TW)

(73) Assignee: Sunworld Industrial Co., Ltd., Tainan Hsien (TW)

( * ) Notice: Subject to any disclaimer, the term of this patent is extended or adjusted under 35 U.S.C. 154(b) by 468 days.

(21) Appl. No.: 12/139,484

(22) Filed: Jun. 15, 2008

(65) Prior Publication Data

US 2009/0266348 A1 Oct. 29, 2009

(30) Foreign Application Priority Data

Apr. 25, 2008 (TW) ..... 97207187 U

(51) Int. Cl.
*F41B 11/00* (2006.01)
*F41B 11/06* (2006.01)

(52) U.S. Cl. ..... 124/31

(58) Field of Classification Search ..... 42/69.01, 42/DIG. 1; 124/31
See application file for complete search history.

(56) References Cited

U.S. PATENT DOCUMENTS

| | | | | |
|---|---|---|---|---|
| 2,557,415 | A * | 6/1951 | Dayton | 42/69.01 |
| 3,188,764 | A * | 6/1965 | Harding | 42/69.01 |
| 3,984,934 | A * | 10/1976 | Weiss | 42/70.01 |
| 4,835,893 | A * | 6/1989 | Kelso | 42/69.01 |
| 6,205,991 | B1 * | 3/2001 | Summers et al. | 124/35.2 |
| 6,651,642 | B1 * | 11/2003 | Powers | 124/35.2 |
| 7,325,539 | B2 * | 2/2008 | Simo et al. | 124/35.2 |

* cited by examiner

*Primary Examiner* — John Ricci

(57) ABSTRACT

A paint ball gun trigger for easy of replacement and orientation change is disclosed, which includes a lower trigger body, an upper trigger body, and an orientation-setting unit. The lower trigger body includes at the top a lower-and-upper body connecting piece, which further includes a screw hole and a positioning hole communicating with said screw hole. The upper trigger body includes at the bottom a lower-and-upper body connecting chamber, and at the lateral side a stabilizing hole communicating with the lower-and-upper body connecting chamber. The orientation-setting unit includes a setting piece, a blocking piece, an elastic element, and an adjusting screw, each of which is assembled in order by screwing into the screw hole of the lower trigger body for orientation change of the lower trigger body.

7 Claims, 8 Drawing Sheets

ADJUSTABLE PAINT BALL GUN TRIGGERS

BACKGROUND OF THE INVENTION

1. Field of the Invention

The invention relates to a paint ball gun trigger for different series of paint ball guns; and more particularly, to the specific structure of a paint ball gun that is modularly designed for adjusting orientation in pressing the trigger to reduce chances of damage and to increase convenience in replacement.

2. Description of the Prior Art

Paint ball guns use compressed gas as the propellant to fire a paint-filled projectile, called a paint ball or a pellet. The paint balls are of spherical shape having a fragile outer shell, and are designed to break on its target and thus deliver its paint to the target surface. Referring to FIG. 7, a conventional paint ball gun has a trigger body, shown by A in FIG. 7, manufactured as an undivided whole piece. Both a first locking screw E and a second locking screw F fix the gun body B and the back handle C together, while the upper part of the trigger main body A inserts into the back handle C and connects pivotally to the back handle C by a trigger screw G. The front handle D is screwed in with the front end of the gun body B.

One disadvantage with the design of a paint ball gun described in FIG. 7 comes from the fact that paint balls are fired by pressing the trigger main body A, which may not appeal to all users and thus have to be designed for specific demands of different users.

Referring to FIG. 8 for replacement of a trigger body A. The first step is to unwind the front handle D, and separate the gun body B from the back handle C by unscrewing both the first screw E and the second screw F with a tool. At this point, the trigger body A is not yet separated from the back handle C; it requires another step to take trigger body A off the back handle C with a tool.

To sum up, some disadvantages associated with the above-mentioned conventional paint ball gun with a trigger, manufactured as an undivided single piece, includes:

(1) Taking other parts off the gun is needed whenever replacement of a trigger is required, which is costly in labor and time;

(2) Due to inconvenient replacement of triggers, users can not have as many choices as they desire in designs of the trigger;

(3) Each specifically designed trigger body adapts to only limited varieties of paint ball gun series. Accordingly, manufacturers of trigger body need to produce and store different types of trigger bodies for each type of paint ball guns; and (4) Pretty uniform design in appearance of triggers due to its manufacturing as an undivided single piece, hardly appealing to all customers in the market.

SUMMARY OF THE INVENTION

The invention refers to a paint ball gun trigger that are modularly designed to reduce chances of being damaged to overcome the inconvenience in replacement and to provide orientation setting change for pressing the trigger, which is a goal unable to achieve in conventional triggers. The modular structure of triggers adapt to varieties of paint ball gun series, reducing manufacturer's cost in storage of replacement triggers.

DETAILED DESCRIPTION OF DRAWINGS

Figure 1:
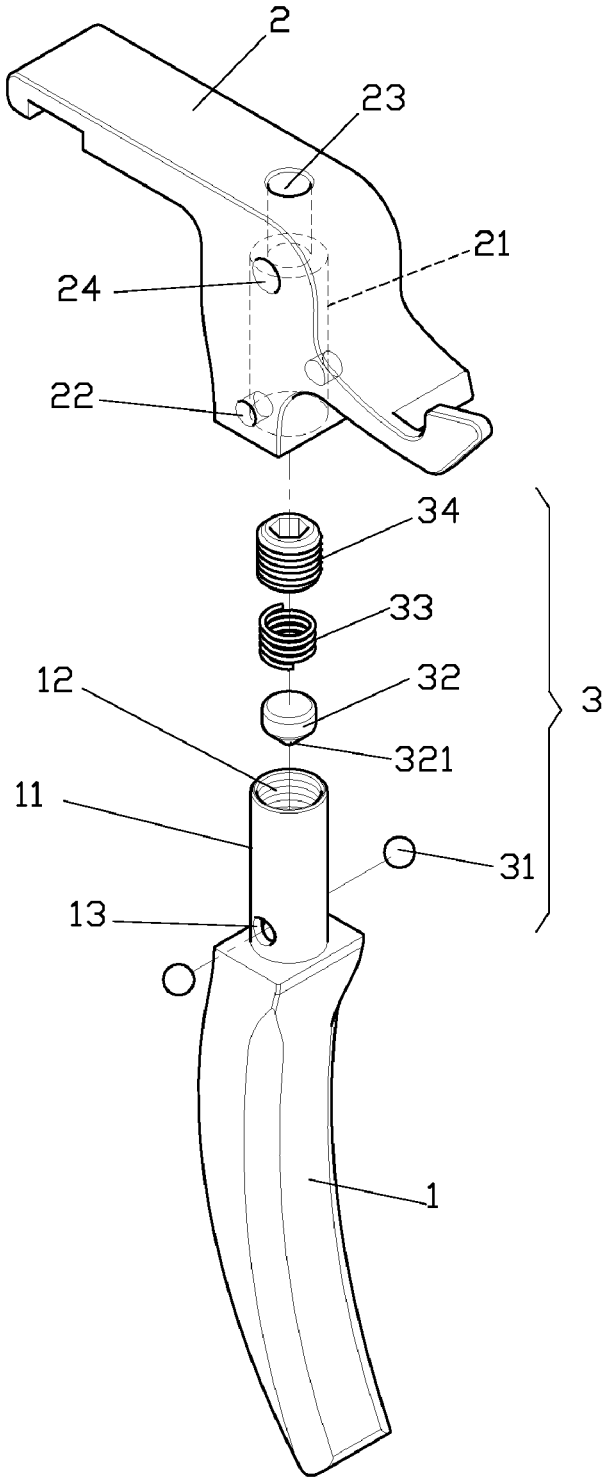
FIG. 1 illustrates a first preferred embodiment in an exploded perspective view of a paint ball gun trigger in accordance with the present invention.
Figure 2:
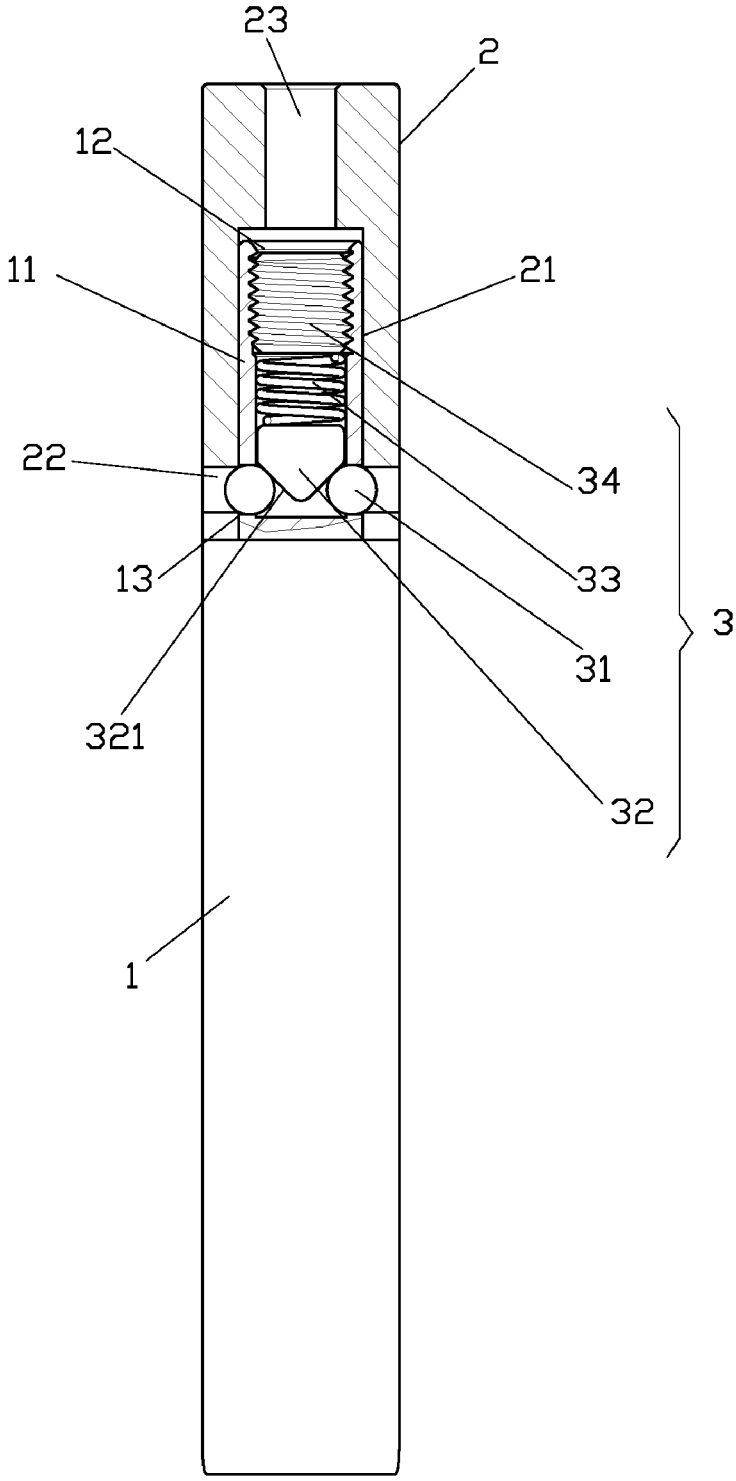
FIG. 2 is a sectional view of a first preferred embodiment in accordance with the present invention.
Figure 3:
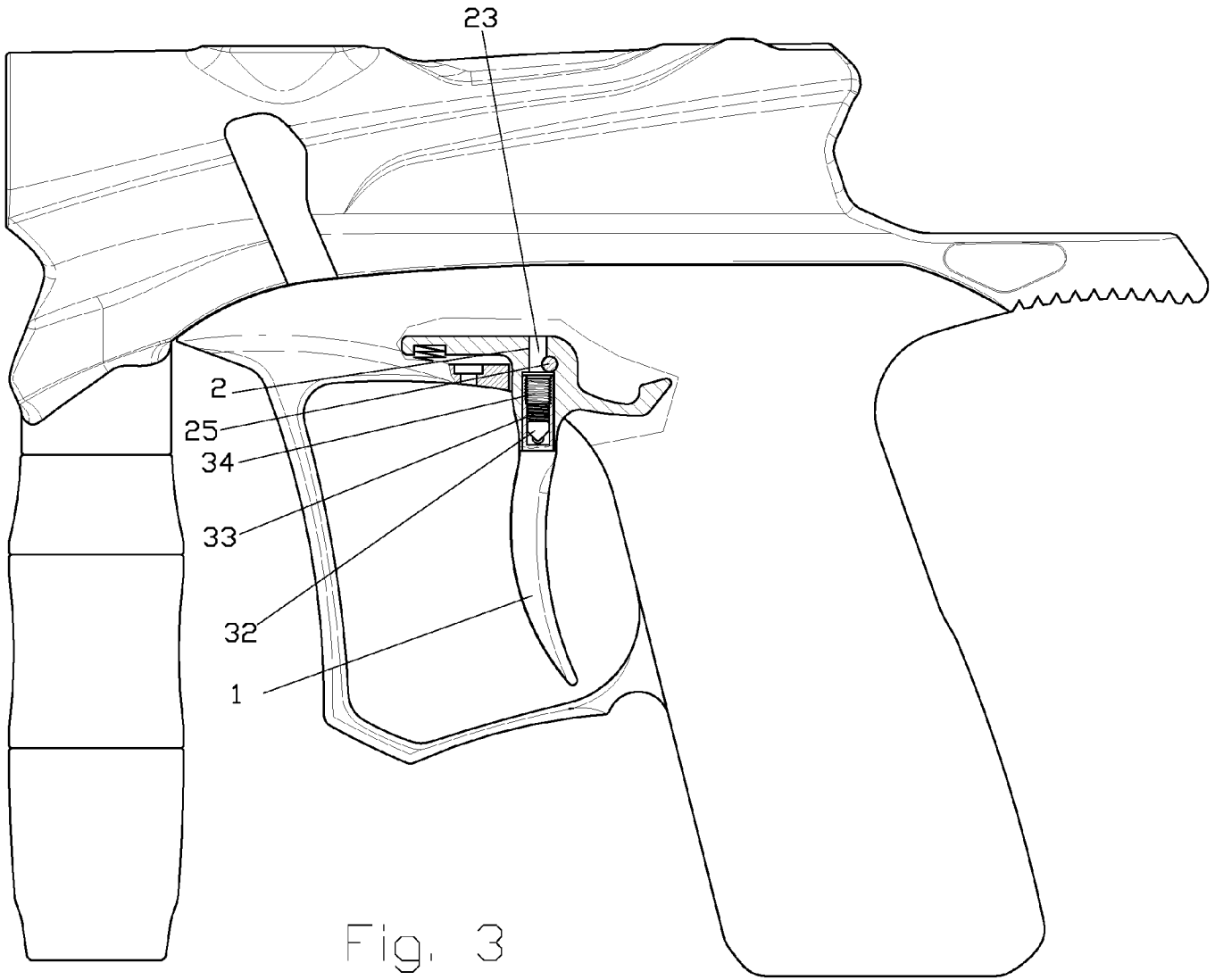
FIG. 3 shows the assembly of a first preferred embodiment in a paint ball gun.

Referring to FIG. 1 to 3, a paint ball gun trigger in accordance with the present invention includes a lower trigger body 1, an upper trigger body 2, and an orientation-adjustable unit 3. The upper trigger body 2 is screwed into the back handle by having a screw bolt 25 going through a pivotally connected hole 24. Details are described below.

Displaced at the top of the lower trigger body 1 is an upper-and-lower body connecting piece 11, the structure of which corresponds to the upper-and-lower body connecting chamber 21 of the upper trigger body 2. Disposed in the center of the upper-and-lower body connecting piece 11 is a spiral hollow 12. A positioning hole 13, communicating with the spiral hollow 12, is disposed in the upper-and-lower body connecting piece 11.

In the same manner, displaced at the bottom of the upper trigger body 2 is the upper-and-lower body connecting chamber 21, corresponding to the upper-and-lower body connecting piece 11. On one lateral side is disposed a fixing hole 22, communicating with the upper-and-lower body connecting chamber 21 (of the upper trigger body 2). A through-hole 23 is disposed at the top of the upper trigger body 2 and communicates with the upper-and-lower body connecting chamber 21.

The orientation-setting unit 3 includes a setting piece 31, a blocking piece 32, an elastic element 33 and an adjusting screw 34, each of which is assembled with the lower trigger body 1 in the spiral hollow 12 for easy of setting an orientation for the lower trigger body 1. The blocking piece 32 further includes an awl-shaped piece 321 at its bottom.

Referring to FIG. 1 to 3 for assembly of parts of a preferred embodiment of the present invention. The setting piece 31, the blocking piece 32, the elastic element 33 and the adjusting screw 34 (of the orientation-setting unit 3) are assembled in order by screwing into the spiral hollow 12 (of the lower trigger body 1) via the adjusting screw 34. Accordingly, the setting piece 31 is situated right under the awl-shaped piece 321 of the blocking piece 32; the elastic element 33 contacts directly with the blocking piece 32 at the top thereof and is controlled by the adjusting screw 34, which in turns determines the degrees of locking of the setting piece 31. Meanwhile, the setting piece 31 is currently protruding outwards in the positioning hole 13 (of the upper-lower body connecting piece 11 of the lower trigger body 1). Next, the upper-lower body connecting piece 11 (of the lower trigger body 1) inserts into the upper-lower body connecting chamber 21 (of the upper trigger body 2) in such a way that the setting piece 31

(of the orientation-setting unit 3) is embedded inside the fixing hole 22 to stabilize the lower trigger body 1.

When users adjusts degrees of tightness or fitness of the setting piece 31 (of the orientation-setting unit 3) in the fixing hole 22 with a manual tool that enters the upper-and-lower body connecting chamber 21 (of the upper trigger body 2) via the through-hole 23 at the top and turns the adjusting screw 34 (of the orientation-setting unit 3) up and down without first taking other parts off the gun.

Figure 4:
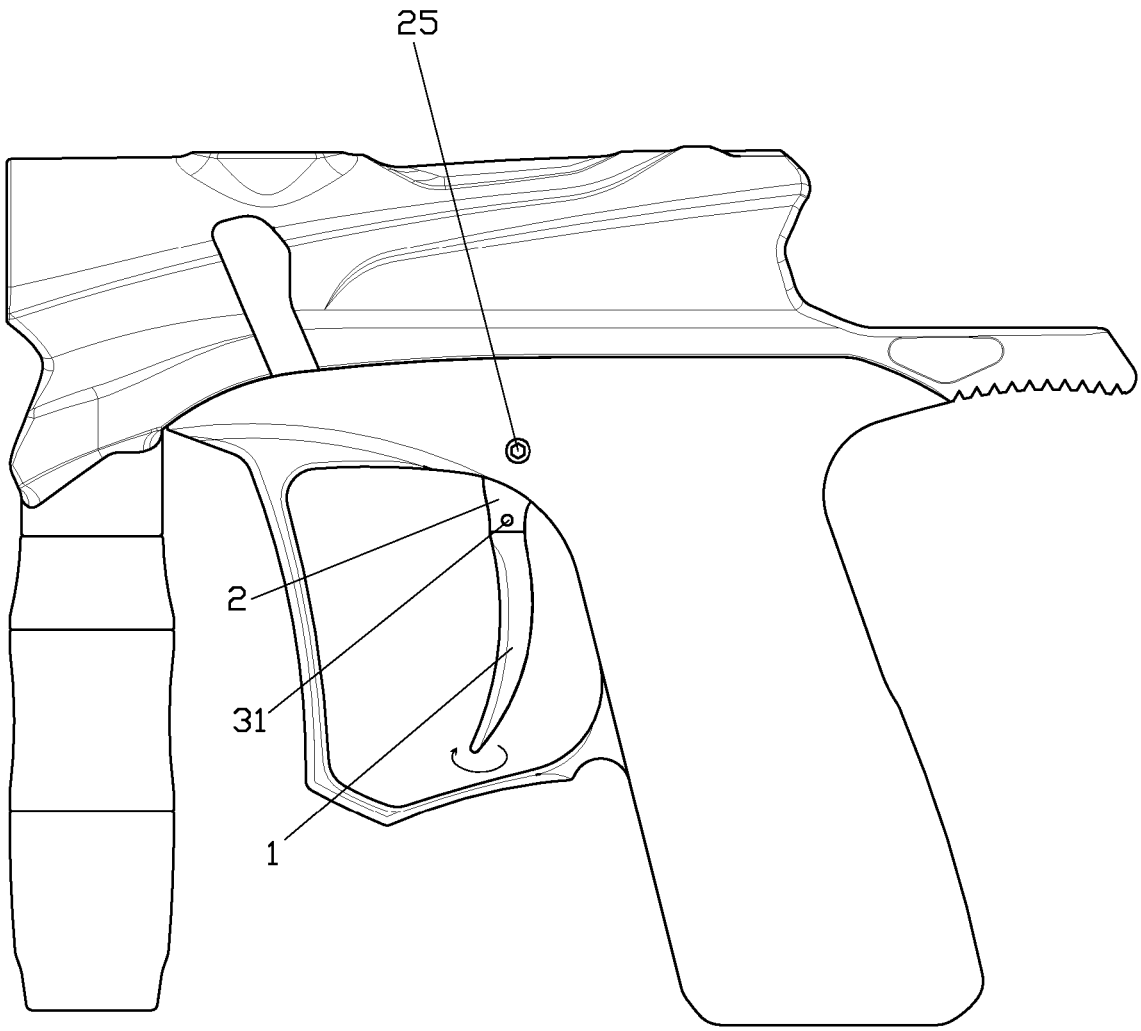
FIG. 4 shows the assembly of a first preferred embodiment in a paint ball gun with its orientation adjusted in a way different from what is shown in FIG. 3.

Referring to FIGS. 2 and 4 for processes involves when the orientation or replacement of trigger is needed. Users simply turn the lower trigger body 1 manually, and the setting piece 31 (of the orientation-setting unit 3) retracts inwards under pressure. After the orientation of trigger is changed, the setting piece 31 (of the orientation-setting unit 3) is embedded in the fixing hole 22 (of the upper trigger body 2). As a result, when it comes to the replacement of a trigger, all that needs to do is to press the setting piece 31 (of the orientation-setting unit 3) for the setting piece 31 to retract inwards under pressure, which in turn separates the lower trigger body 1 from the upper trigger body 2 right away.

Preferably, the setting piece 31 (of the orientation-setting unit 3) is a steel ball.

Figure 5:
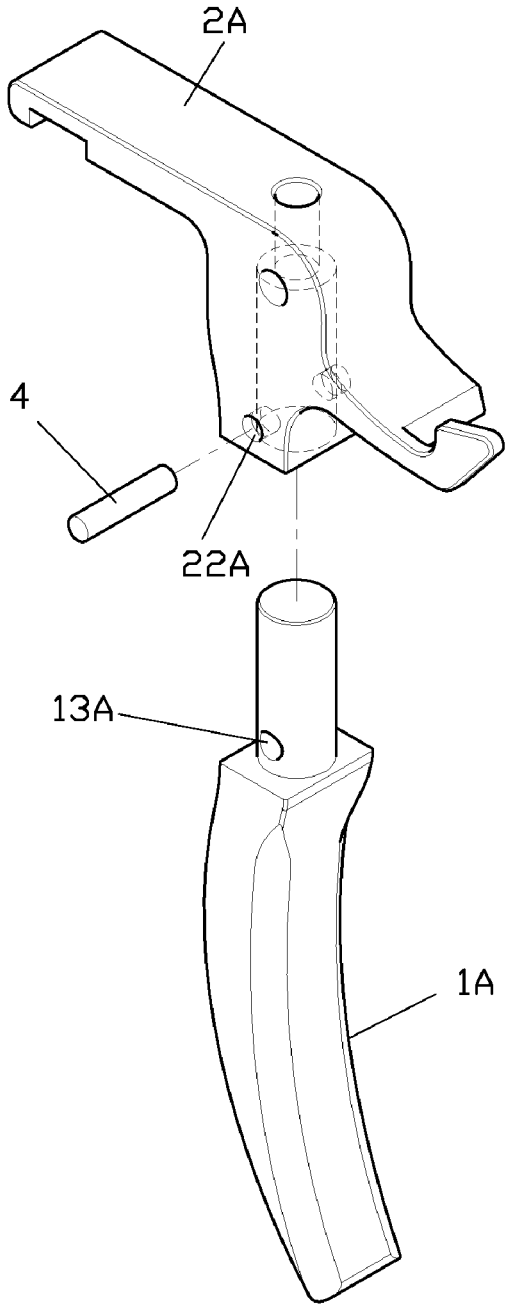
FIG. 5 illustrates a second preferred embodiment in an exploded perspective view of a paint ball gun trigger in accordance with the present invention.

Consulting FIG. 5 while in reference to FIG. 1 for a second preferred embodiment of the present invention. An alternate and equivalent device for the orientation-setting unit 3 is a positioning piece 4, which assemblies the upper trigger body 2A together with the lower trigger body 1A by insertion into the stabilizing hole 22 A (of the upper trigger body 2A) as well as the positioning hole 13A, for easy of changing orientation or replacement of a trigger.

Figure 6:
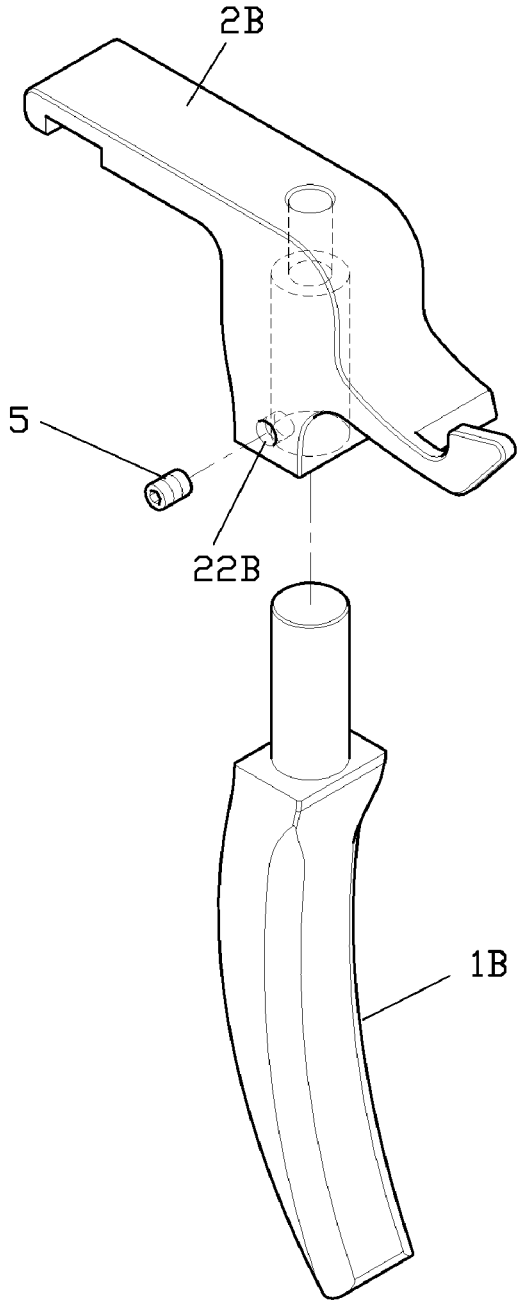
FIG. 6 illustrates a third preferred embodiment in an exploded perspective view of a paint ball gun trigger in accordance with the present invention.
Figure 7:
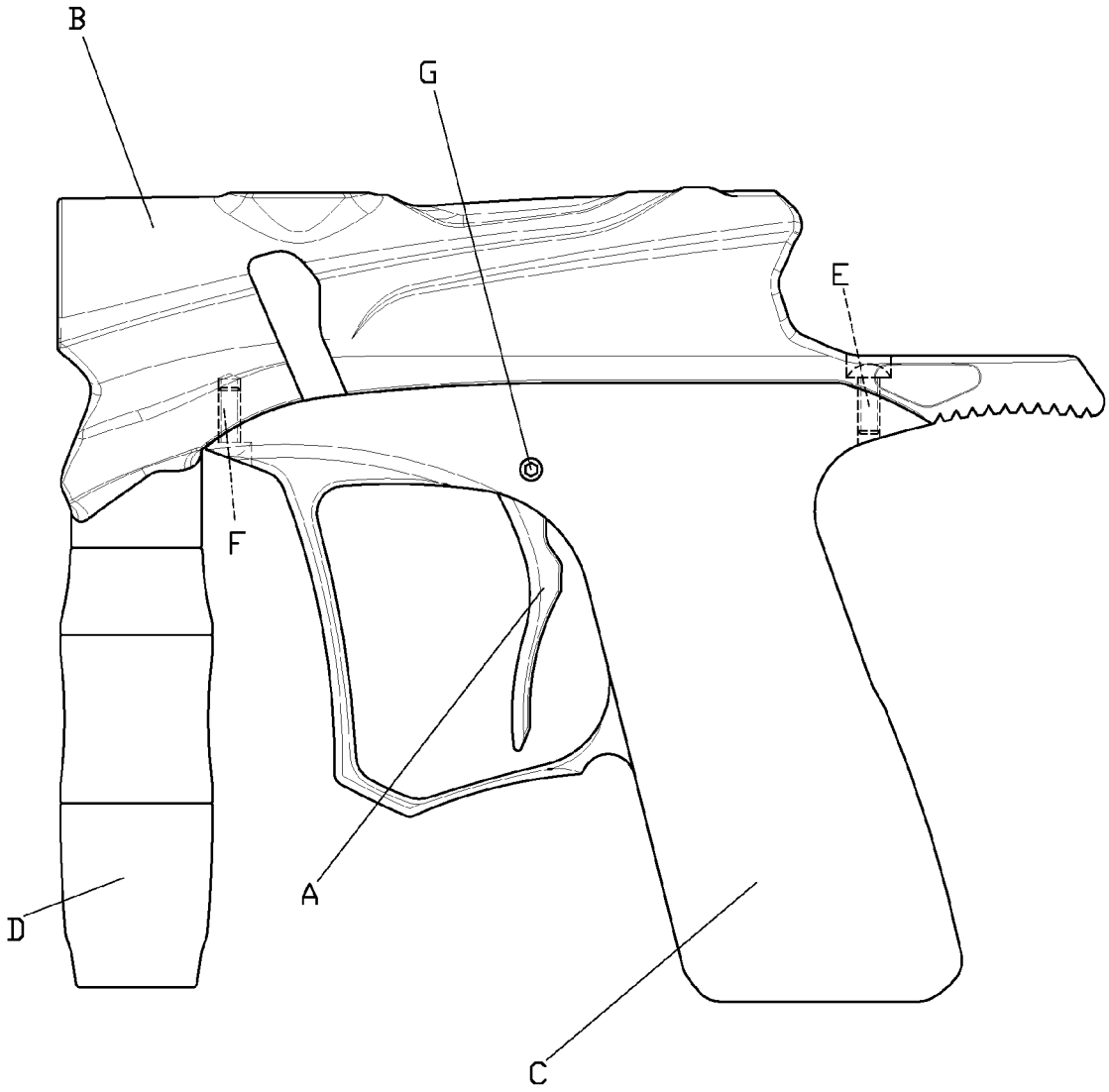
Fig. 7 Prior Art
FIG. 7 shows the assembly of a trigger of a conventional paint ball gun.
Figure 8:
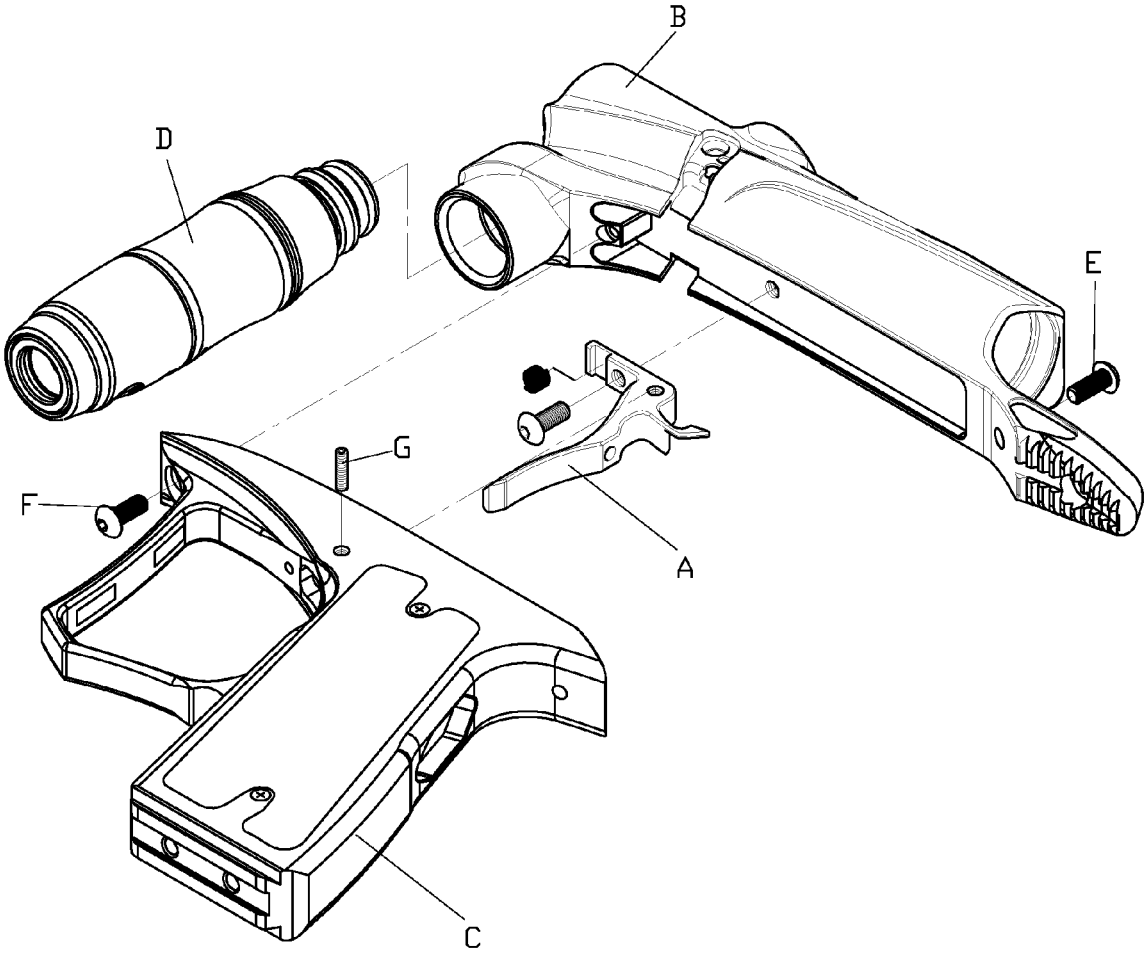
Fig. 8 Prior Art
FIG. 8 shows the parts required to be taken off the gun when replacing a trigger of a conventional paint ball gun.

Consulting FIG. 6 while in reference to FIG. 1 for a second preferred embodiment of the present invention. An alternate and equivalent device for the orientation-setting unit 3 is a locking screw 5, which stabilizes the lower trigger body 1B in position by direct and tight contact, again, for easy of changing orientation or replacement of a trigger.

I claim:

1. A paint ball gun trigger, which includes lower trigger body, including at the top a lower-and-upper body connecting piece, which further includes a screw hole and a positioning hole communicating with said screw hole;

an upper trigger body, including at the bottom a lower-and-upper body connecting chamber, and at the lateral side a stabilizing hole communicating with said lower-and-upper body connecting chamber;

an orientation-setting unit, including a setting piece, a blocking piece, an elastic element, and an adjusting screw, each of which is assembled in order by screwing into said screw hole of said lower trigger body for orientation change of said lower trigger body.

2. The paint ball gun trigger as claimed in claim 1, wherein at the top of said upper trigger body is disposed a through-hole.

3. The paint ball gun trigger as claimed in claim 1, wherein the bottom of said blocking piece is awl-shaped.

4. The paint ball gun trigger as claimed in claim 1, wherein said setting piece of said orientation-setting unit is a steel ball.

5. The paint ball gun trigger as claimed in claim 1, wherein said setting piece of said orientation-setting unit is a positioning piece.

6. The paint ball gun trigger as claimed in claim 1, wherein said setting piece of said orientation-setting unit is a locking screw.

7. The paint ball gun trigger as claimed in claim 1, wherein said stabilizing hole of said upper trigger body is a screw hole.

* * * * *